United States Patent [19]

Bell et al.

[11] Patent Number: 5,040,777

[45] Date of Patent: Aug. 20, 1991

[54] FOOT PEDAL OPERATED, MODULAR, ROLL UP PAPER FEEDER APPARATUS

[75] Inventors: Conrad J. Bell, Webster; Alan B. Amidon, Fairport, both of N.Y.

[73] Assignee: Xerox Corporation, Stamford, Conn.

[21] Appl. No.: 425,789

[22] Filed: Oct. 23, 1989

[51] Int. Cl.[5] ..... B65H 3/06

[52] U.S. Cl. ..... 271/3; 271/42; 271/105; 271/129; 271/149; 271/223; 271/118

[58] Field of Search ..... 271/3, 9, 21–24, 271/42, 129, 149, 105, 207, 223, 118

[56] References Cited

U.S. PATENT DOCUMENTS

| | | | |
|---|---|---|---|
| 3,866,901 | 2/1975 | Brock | 271/21 |
| 4,026,538 | 5/1977 | Brown | 271/42 |
| 4,053,152 | 10/1977 | Matsumoto | 271/9 |
| 4,157,822 | 6/1979 | Miller | 271/9 |
| 4,823,963 | 4/1989 | Helmetsie | 211/50 |

OTHER PUBLICATIONS

Standard Xerographic Master Making Equipment, pp. 1–28.

*Primary Examiner*—Richard A. Schacher
*Attorney, Agent, or Firm*—William A. Henry, II

[57] ABSTRACT

A low cost, paper feeder for large copy sheets includes a media chamber mounted to support copy sheets in a substantially vertical plane. A two-position, T-shaped feeder mechanism including a pair of one-way clutch controlled feed rolls is slidably mounted on a rail for contacting the media. A foot pedal is connected to the feeder mechanism such that when movement of the foot pedal is initiated, the feeder mechanism is moved in a first direction to a position contacting the copy sheets and with continued movement of the foot pedal, a top sheet of the copy sheets is moved by the feeder mechanism out of the tray in a second direction a predetermined amount to a copier wait station, and with return of the foot pedal to its initial position, the feed mechanism is caused to retract from the surface copy sheets in a third direction to its initial position.

23 Claims, 8 Drawing Sheets

FOOT PEDAL OPERATED, MODULAR, ROLL UP PAPER FEEDER APPARATUS

This invention relates to printing machines, and more particularly, to a foot pedal operated, roll up paper feeder apparatus to be used with such a machine.

In the art of xerography or other similar image reproducing arts, a latent electrostatic image is formed on a charge-retentive surface such as a photoconductor which generally comprises a photoconductive insulating material adhered to a conductive backing. This photoconductor is first provided with a uniform charge after which it is exposed to a light image of an original document to be reproduced. The latent electrostatic images, thus formed, are rendered visible by applying any one of numerous pigmented resins specifically designed for this purpose. In the case of a reusable photoconductive surface, the pigmented resin, more commonly referred to as toner which forms the visible images is transferred to plain paper.

It should be understood that for the purpose of the present invention, the latent electrostatic image may be generated from information electronically stored or generated, and the digital information may be converted to alphanumeric images by image generation electronics and optics. However, such image generation electronic and optic devices form no part of the present invention.

Paper feeders are used with automated drive rolls throughout the industry in conjunction with printers or copiers of the type just discussed in order to feed copy sheets at a high rate of speed and thereby increase the throughout of the machines. These feeders are costly, cumbersome and quite complicated when evaluated for use in feeding sheets in low cost, slow speed machines. It has become increasingly common to feed copy sheets in some of these machines measuring 18, 24, 36 or 48×36, however, use of prior sheet feeders for this application has been costly and difficult at best. One attempt in the past at feeding sheets economically is shown in the Xerox Model D, No. 4, Xerographic Flat Plate machine. Copy sheets are manually fed by pulling a lever in front of the machine that is connected to a ratchet controlled feed roll assembly that is resting on top of a horizontally supported stack of sheets in a feed tray. The ratchet mechanism will not allow the feed rolls to rotate as they are pulled over the top of sheets in the tray. Once a sheet is pulled forward by use of the lever and feed rolls, the lever is released with the ratcheting causing the feed rolls to rotate in a reverse direction so as to not disturb the sheets remaining in the stack. This procedure is repeated for each sheet that is fed. Replenishing of the copy sheets is a major drawback to this type of feeding. The feed tray is positioned in a horizontal plane and has to be loaded from the outside the machine. First, the tray has to be removed from the machine, then the top of the tray opened. Next, the feed roll assembly is lifted up and rotated toward the back of the tray. Paper can then be added to the tray. As one can appreciate, this loading procedure would be especially cumbersome and difficult when handling "D" size sheets measuring 24×36. A cost effective device for the feeding of sheets 24×36 or the like from a feed tray has been disclosed in U.S. application Ser. No. 07/359,611 that is simple, low cost, and either hand operated or electrically driven for use in a heated media chamber that allows the media to exit the tray through a membrane. The paper feeder includes a slide, handle/rod, lift bracket and T-shaped actuator with feed means as a part thereof. The chamber is tilted about 20° with respect to a horizontal plane for ease of loading as well as for inhibiting multifeeding. However this solution requires one to use one's hands in order to manipulate these large unwieldy sheets. U.S. Pat. No. 4,823,963 shows a rack with two parallel trays adapted for use with a wide format photocopy machine or the like. One tray holds originals yet to be copied while the other tray holds originals already copied. The rack fits over and behind the photocopy machine so as to not require an additional workspace. This system does not address the problem of handling wide format copy sheets. U.S. Pat. No. 4,053,152 is directed to a vertical sheet feeding device which includes a means for fanning out a first portion of a stack. The stack is supported generally vertically and the fanning out means also includes means for restraining a second and different portion of the stack. The paper feed device allows air to enter between sheets of paper or the like in the stack to prevent the occurrence of double feeding. This system too is not readily adaptable to feeding "D" size sheets.

Therefore, In accordance with the present invention, a low cost, foot pedal operated roll up large media feeder is disclosed that includes a media chamber mounted in a vertical plane that allows media to exit through a top portion thereof into feed rolls of a printer apparatus. A two position, T-shaped actuator means includes a pair of one-way clutch controlled rotating friction means mounted thereon for contacting media within the media chamber. A rail means slidably supports the actuator means. A foot pedal is linkably connected to the actuator means such that pressing of the foot pedal moves the actuator means in a first direction to a position contacting the media with continued pressing of the foot pedal causing the actuator means to move in a second direction and thereby cause the top sheet of the media to be removed a predetermined amount through the top portion of the media chamber. Release of the foot pedal causes the actuator means to retract from the media surface and move in a third direction and subsequently to its initial position. Replenishment of copy paper is accomplished by simply opening a door in the top of the media chamber, sliding copy paper into the chamber and closing the door.

Figure 1:
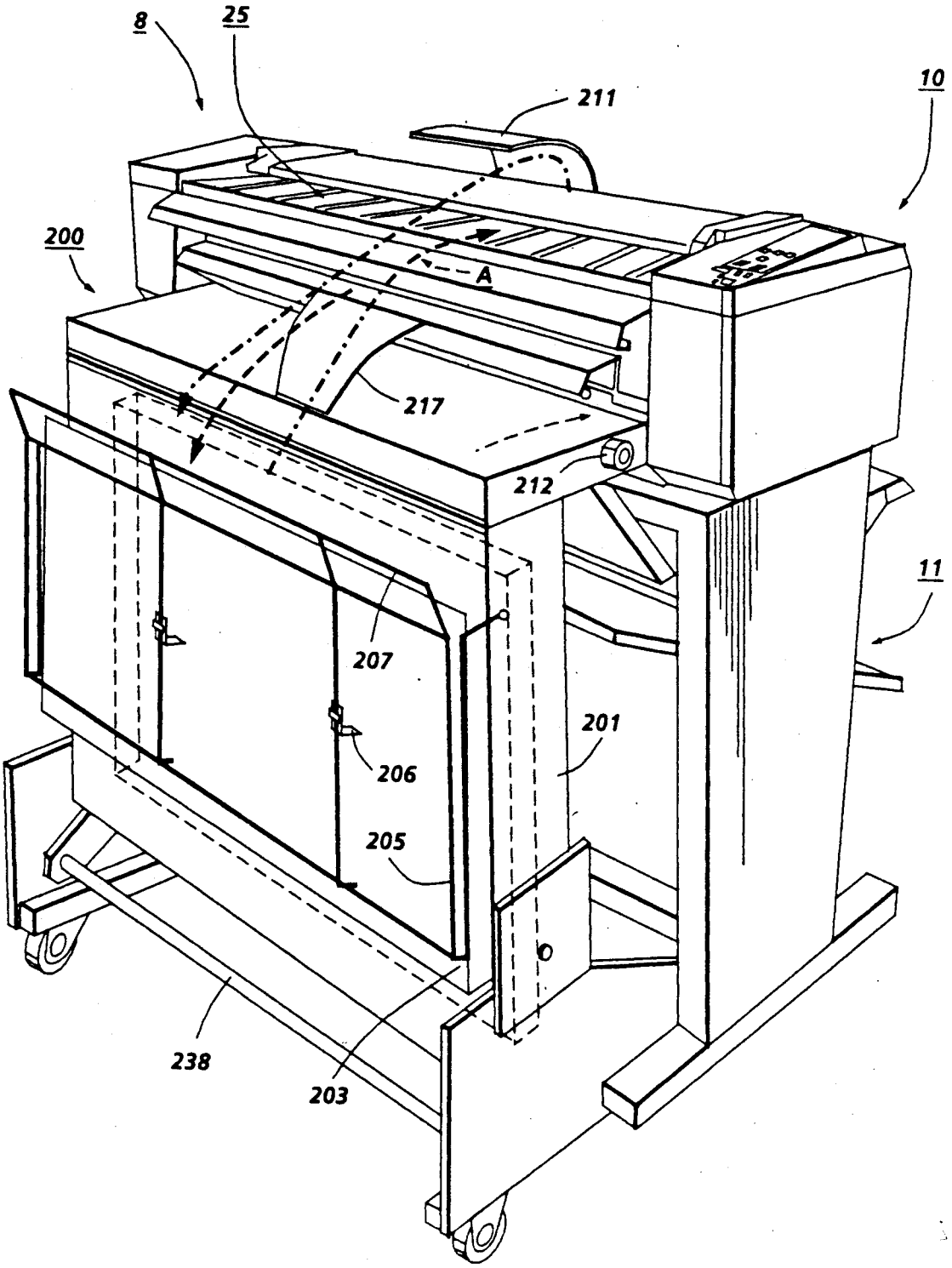
FIG. 1 is an isometric view of a machine incorporating the features of the present invention.
Figure 2:
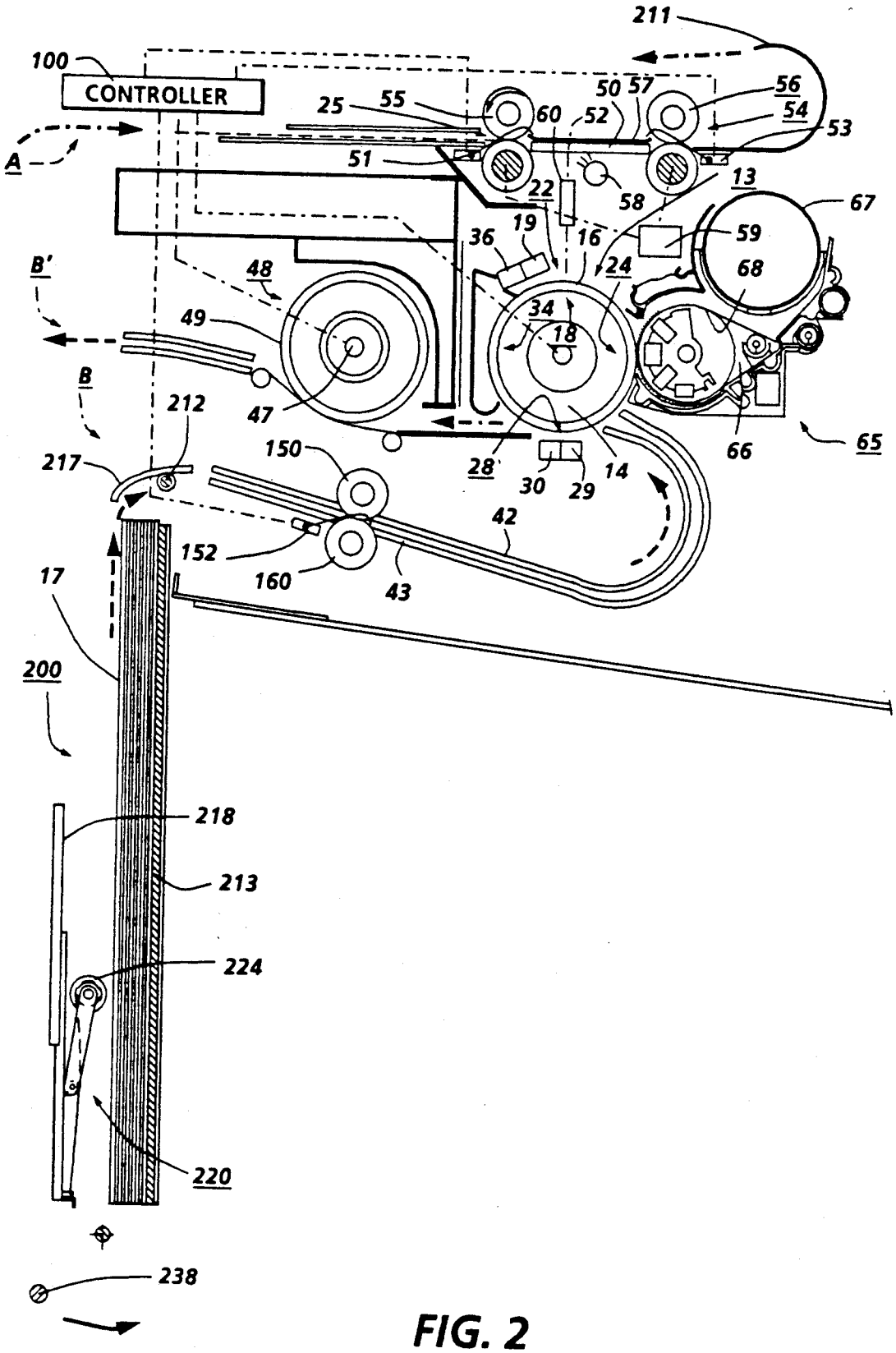
FIG. 2 is a partial side view schematic of the machine of FIG. 1 showing part of the present invention.

Referring to FIGS. 1 and 2 of the drawings there is shown by way of example an automatic xerographic reproduction or printing machine, designated generally by the numeral 8 incorporating the idler structure of the present invention.

Machine 8 has a suitable frame or housing 10 within which the machine xerographic section 13 is operatively supported. The xerographic section 13 is supported by stand 11. Briefly, and as will be familiar to those skilled in the art, the machine xerographic section 13 includes a recording member, shown here in the form of a rotatable photoreceptor 14. In the exemplary arrangement shown, photoreceptor 14 comprises a drum having a photoconductive surface 16. Other photoreceptor types such as belt, web, etc. may instead be contemplated. Operatively disposed about the periphery of photoreceptor 14 are charge station 18 with charge corotron 19 for placing a uniform charge on the photoconductive surface 16 of photoreceptor 14, exposure station 22 where the previously charged photoconductive surface 16 is exposed to image rays of the document being copied or reproduced, development station 24 where the latent electrostatic image created on photoconductive surface 16 is developed by toner, transfer station 28 with transfer corotrons 29, 30 for transferring the developed image to a suitable copy substrate material such as a copy sheet 17 brought forward in timed relation with the developed image on photoconductive surface 16, and cleaning station 34 that could include a cleaning blade and discharge corotron 36 for removing leftover developer from photoconductive surface 16 and neutralizing residual charges thereon.

Copy sheets 17 are brought forward to transfer station 28 by idler roll 150 and registration/drive roll 160 which is controlled by sensor 152 through controller 100, with sheet guides 42, 43 serving to guide the sheet through an approximately 180° turn prior to transfer station 28. Following transfer, the sheet 17 is carried forward to a fusing section 48 where the toner image is fixed by fusing roll 49. Fusing roll 49 is heated by a suitable heater such as lamp 47 disposed within the interior of roll 49. After fixing, the copy sheet 17 is discharged into a catch tray 205 which is part of the roll up feeder 200 of the present invention.

A transparent platen 50 supports a document as the document is moved past a scan point 52 by a constant velocity type transport 54. As will be understood, scan point 52 is in effect a scan line extending across the width of platen 50 at a desired point along platen 50 where the document is scanned line by line as the document is moved along platen 50 by transport 54. Transport 54 has input and output document feed roll pairs 55, 56, respectively, on each side of scan point 52 for moving a document across platen 50 at a predetermined speed. Exposure lamp 58 is provided to illuminate a strip-like area of platen 50 at scan point 52. The image rays from the document line scanned are transmitted by a gradient index fiber lens array 60 to exposure station 22 to expose the photoconductive surface 16 of the moving photoreceptor 14.

Developing station 24 includes a developer housing 65, the lower part of which forms a sump 66 for holding a quantity of developer within canister 67. As will be understood by those skilled in the art, developer comprises a mixture of larger carrier particles and smaller toner or ink particles. A rotatable magnetic brush developer roll 68 is disposed in predetermined operative relation to the photoconductive surface 16 in developer housing 65, roll 68 serving to bring developer from sump 66 into developing relation with photoreceptor 14 to develop the latent electrostatic images formed on the photoconductive surface 16. All of the machine functions are controlled by conventional controller or microprocessor.

Roll-up paper feeder 200 includes copy sheets 17 that are supported in stack-like fashion substantially vertical on a horizontal base portion 202 of copy sheet supply tray 201. An angle of approximately 13 degrees from a vertical plane would be an acceptable positioning of tray 201. A T-shaped actuator means 220 with feed means in the form of hollow, cylindrical rolls 224 and 225 is manipulated against the topmost copy sheet 17 of the stack of sheets in order to feed the topmost copy sheet into the nip of the registration roll pair which registers the copy sheets with the image on the photoconductive surface 16 of photoreceptor 14. Registration roll pair 150, 160 advance the copy sheet to transfer station 28. There, suitable transfer/detack means such as transfer/detack corotrons 29, 30 bring the copy sheet into transfer relation with the developed image on photoconductive surface 16 and separate the copy sheet therefrom for fixing and discharge as a finished copy. The top surface of roll-up feeder 200 serves as a copy sheet support and bypass guide in order to allow an operator to feed copy sheets into the machine separate from the feeder unit.

As shown in FIGS. 2–5C, Paper feeder 200 comprises a copy sheet supply tray 201 that could be heated, if desired, with copy sheets 17 positioned therein and supported in stack-like fashion on base 202. Heating of the tray maintains dryness of the sheets as well as prevents curl from setting up in the sheets. A T-shaped, two-position actuator means 220 is positioned adjacent to and removed from the copy sheets and has a support member 221 slidably positioned within a channel of slide member 218 for movement up and down within the slide. The actuator means 220 includes feed means 224 and 225 on opposite extremities and is controlled by a leaf spring mechanism 219 such that when foot pedal 238 is in a first position, (FIG. 3A) the actuator means is removed from the sheet stack and when foot pedal 238 is in a second position (FIG. 3B), the actuator means is loaded in a first direction against the first copy sheet 17 in the stack of sheets into operative relationship with one-way clutch 216 (FIG. 3A) controlled feed means or feed rolls 224 and 225. During this movement of the actuator means, leaf spring 219 is acting against the movement. Feed rolls 224 and 225 are mounted on an articulable shaft in order to prevent skewing of the media during the feeding process and are manipulated by continued pressing on foot pedal 238 to be moved in a second and upward direction away from the bottom of the tray in order to feed the topmost copy sheet to a point where it is captured by the nip of the idler/registration roll pair 150, 160 which registers the copy sheet with the image on the photoconductive surface 16 of the photoreceptor. Registration roll 160 advances each copy sheet to transfer station 28 by way of metering roll 212. Metering roll 212 is rotated by friction between it and a copy sheet and serves to alert the operator that a sheet has been feed and when it stops rotating, the operator knows that it is time to prepare to feed another sheet. Return of foot pedal 238 to its first or rest position causes the actuator means to slide in a third direction downward within channel 218 with one-way clutch 216 allowing the feed rolls to roll against the sheet stack and thereby not disturb the remaining sheets in the stack. Movement of the actuator in this downward direction will also cause leaf spring mechanism 219 to take over control of the actuator member and cause it to be moved thereby away from the stack and not make frictional contact with the top or first sheet of the sheets remaining in the stack during return of the foot pedal to its first position. The foot pedal can be manipulated to present a fresh copy sheet to the registration roll as use requires. It should be understood that a motor could replace the foot pedal and friction pads could replace the rolls, if desired.

Figure 3A:
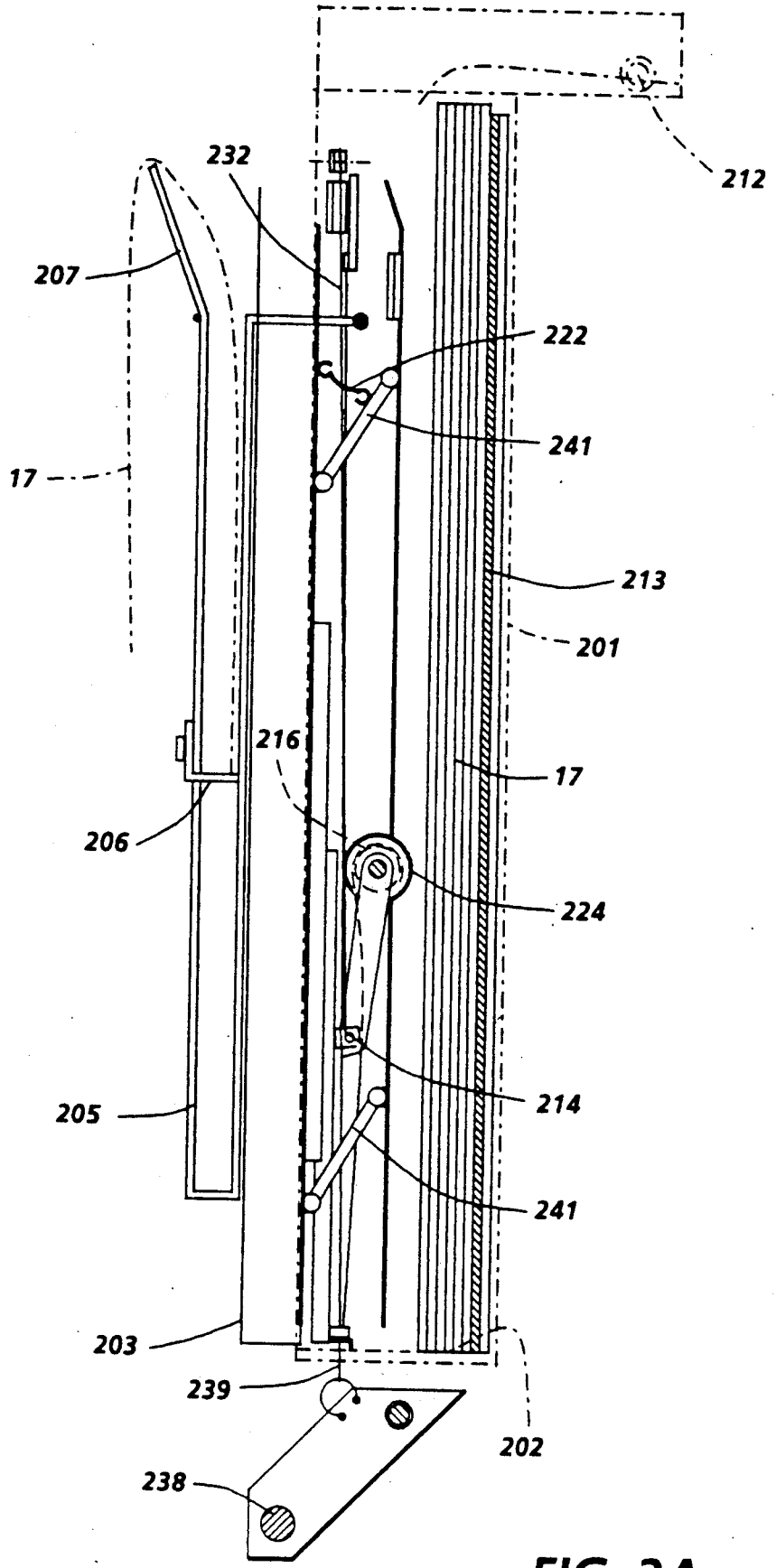
FIG. 3A is a partial side elevational view of the paper feeder structure of FIG. 2 with a feed member in its home position.
Figure 3B:
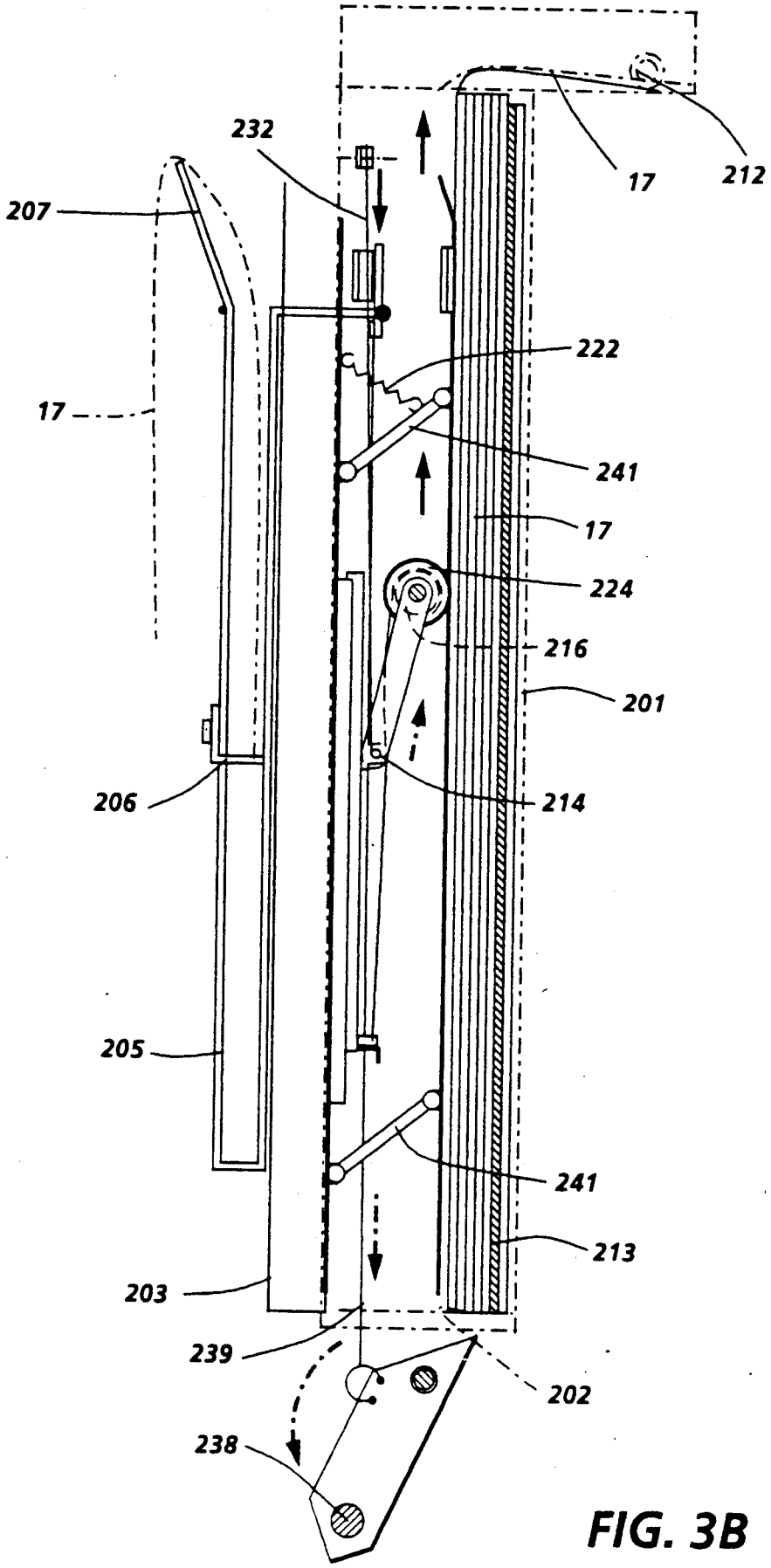
FIG. 3B is a partial side elevation of the paper feeder of FIG. 3A showing the feed member of the paper feeder in its actuated position.

With reference to FIGS. 3A and 3B, Copy sheet tray 201 has an attachment 203 connected to its outer surface that is used to store original documents as copying of a particular document is taking place or for later copying or for storing documents that have already been copied. The documents to be copied are stored face or printed side forward or toward the outer wall of the tray 201 while documents that have already been copied are guided by baffle 211 into tray 201 and stored facing away from the outer surface of the tray. Attachment 203 also has a separate catch tray compartment 205 for catching copy sheets as they exit the machine. The lead edges of copy sheets are guided by baffle means 217 into contact with a support surface means 206 of the catch tray with continued transport of the copy sheets by the machine causing a trail edge portion of each copy sheet to flip away from the machine and over an angled top portion 207 of the catch tray. This is useful because as each job is finished, the operator will grasp the collated documents document storage attachement 203 with one hand and the copy sheets in compartment 205 with the other prior to leaving the machine. Support member 206 is adjustable in order to accommodate different sizes of copy sheets.

Figure 4:
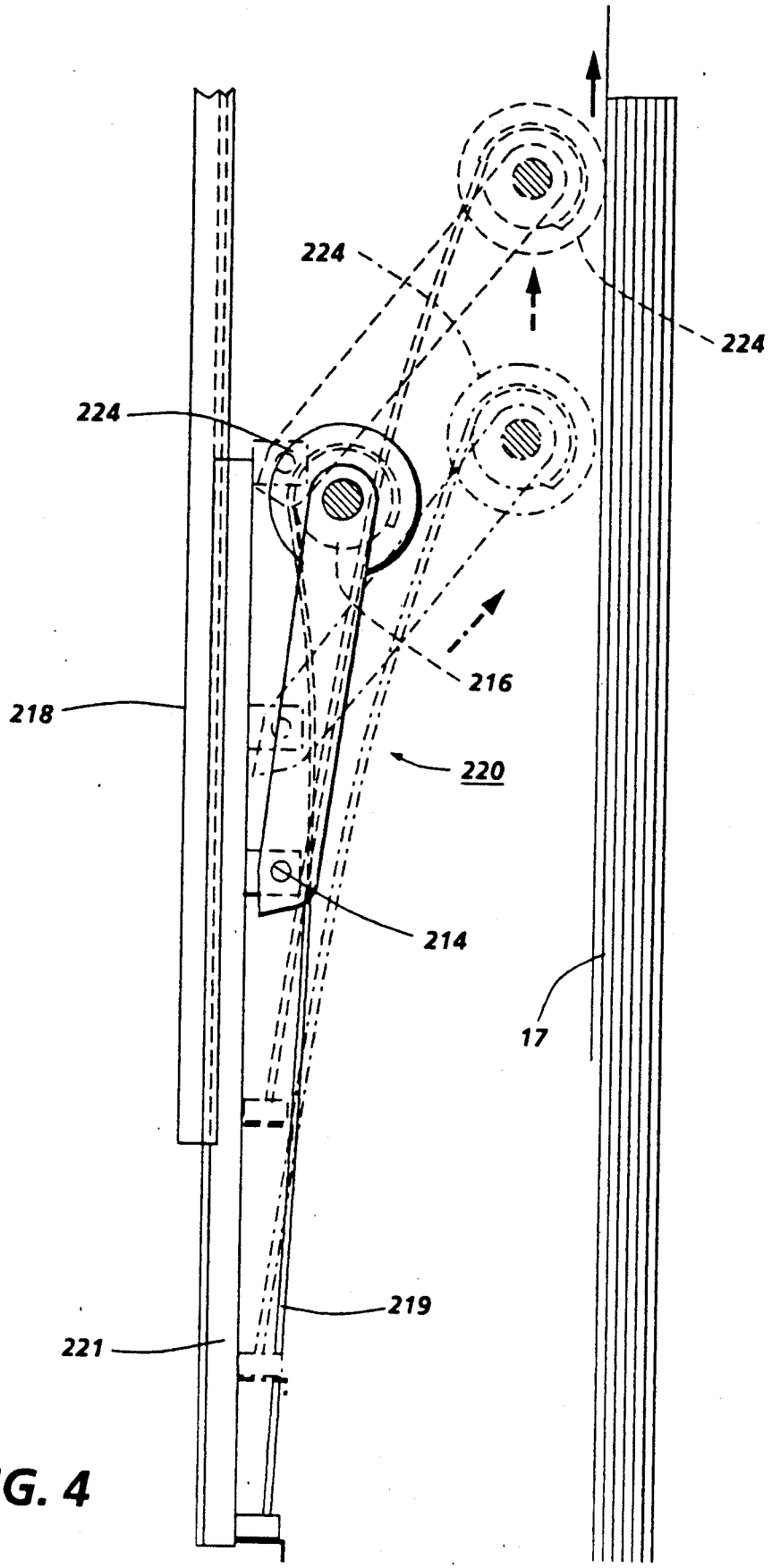
FIG. 4 is an enlarged partial side elevation of the paper feeder of FIG. 3A depicting the paper feeding sequence of the paper feeder.
Figure 5A:
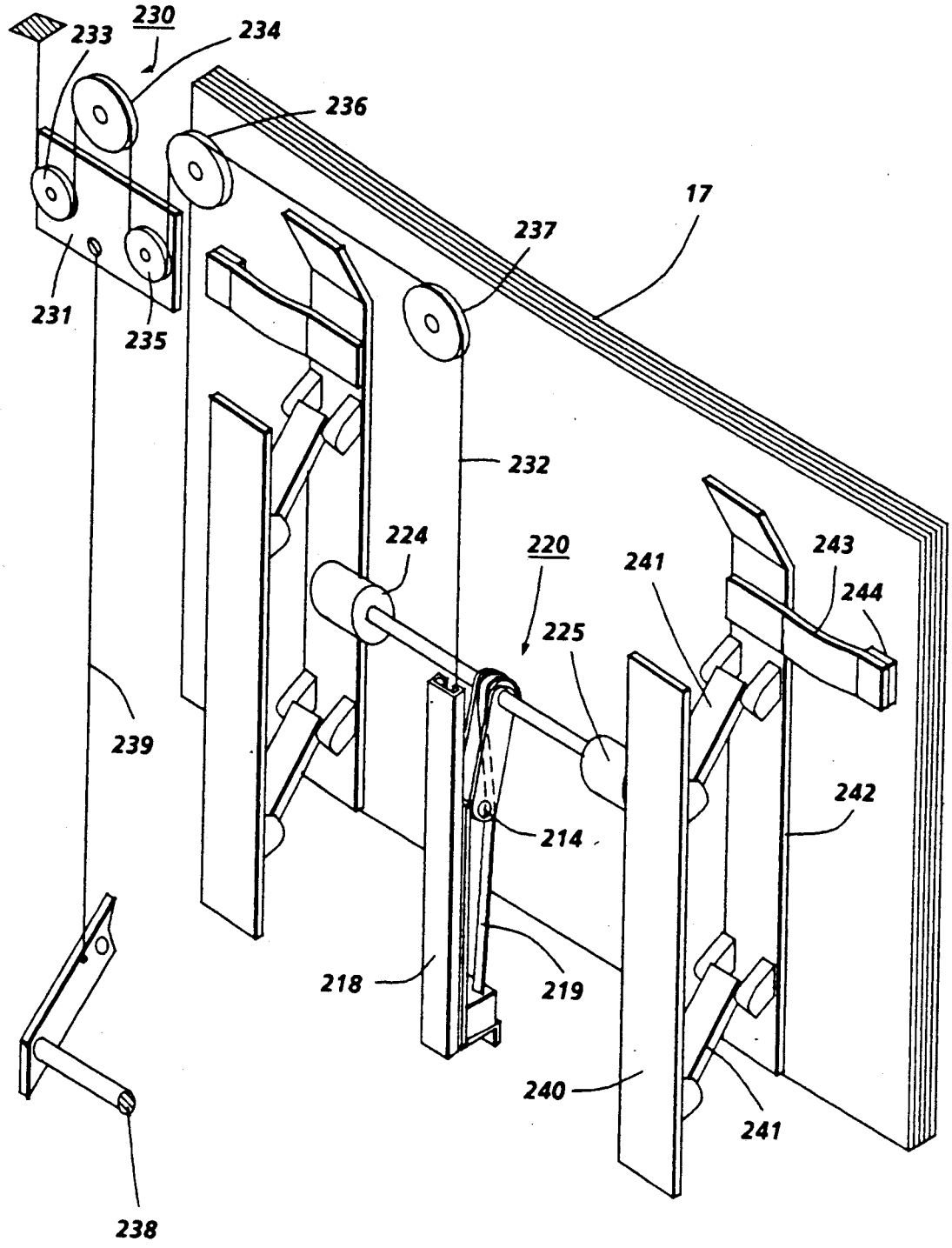
FIG. 5A is an enlarged partial isometric view of the paper feeder of FIG. 3A showing the drive mechanism for the feed member in an unactuated position.
Figure 5B:
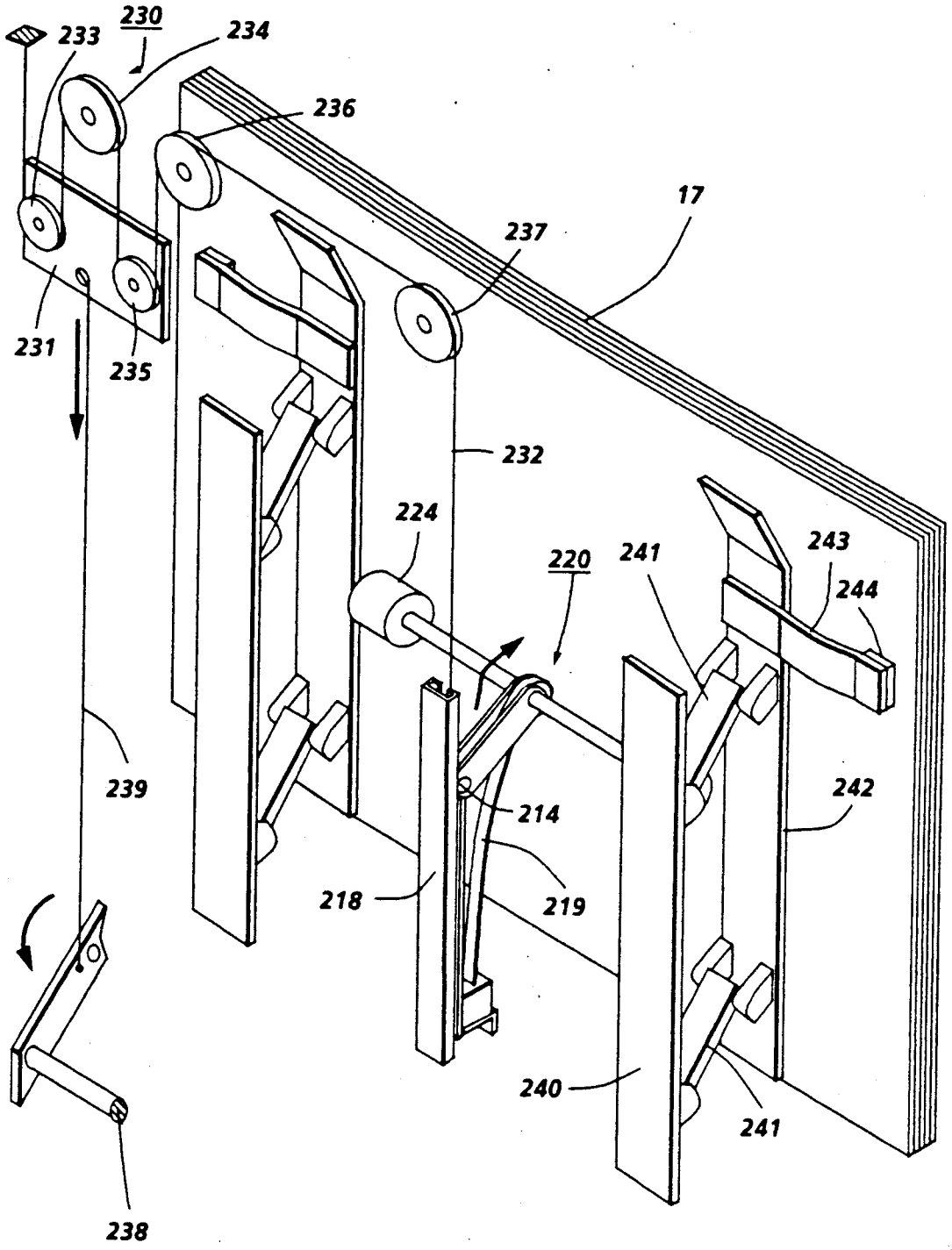
FIG. 5B is an enlarged partial isometric view of the paper feeder of FIG. 3A showing the drive mechanism for the feed member in an actuated position.
Figure 5C:
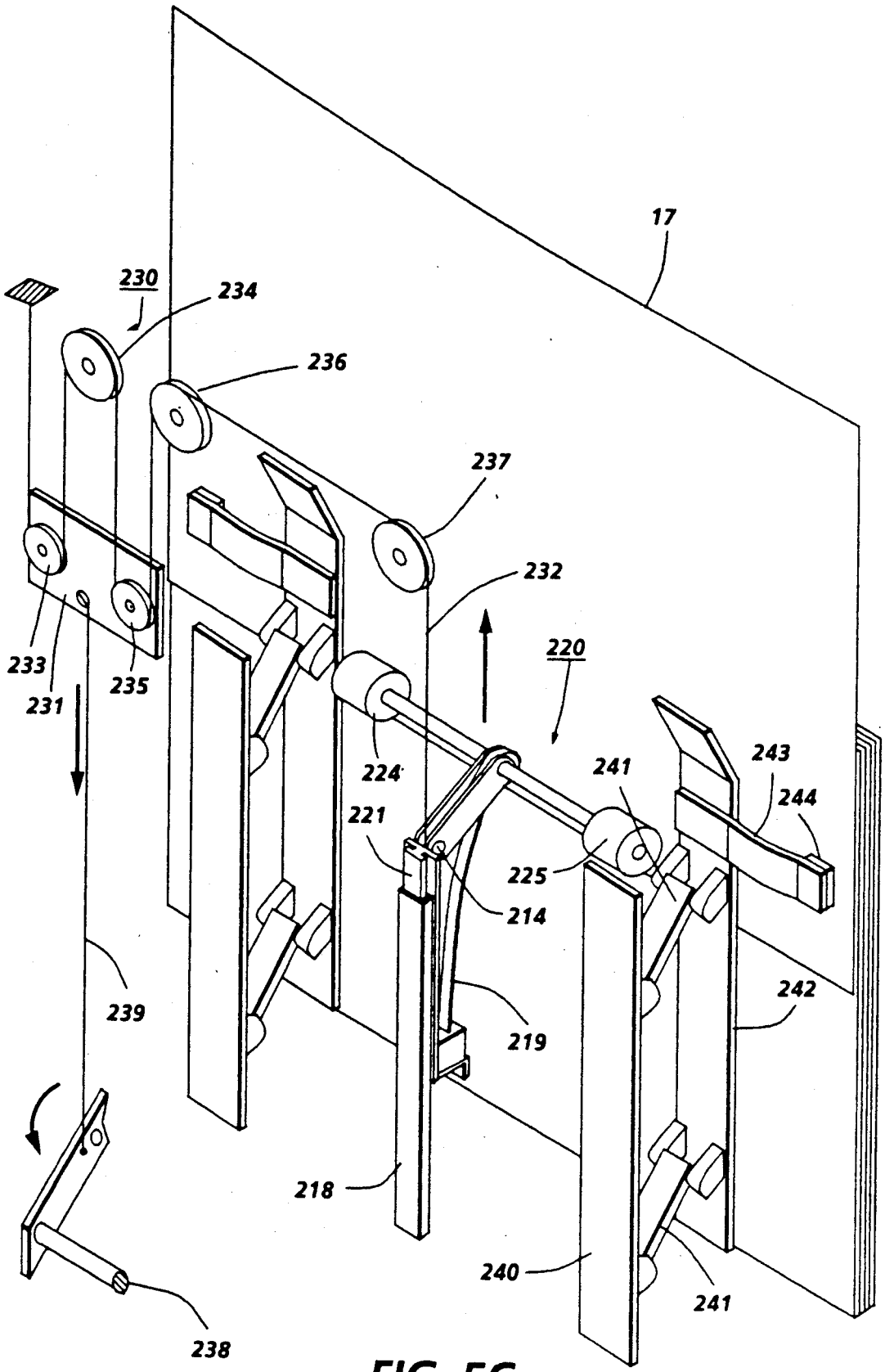
FIG. 5C is an enlarged partial isometric view of the paper feeder of FIG. 3A showing the drive mechanism for the feed member in an actuated position and feeding on individual sheet from a stack.

Pulley drive mechanism 230 for the actuator member as shown in FIGS. 5A–5C includes a block 231 and tackle 232 in the form of a wire that is used in conjunction with a series of wheels 233 through 237 with wire 232 being connected to the actuator member as shaft 214 (FIG. 4). A wire 239 connects foot pedal 238 to block 231 of the drive mechanism. Copy sheets within tray 201 are taught lightly and held upright opposite roll 225 by a pad 244 on an orthogonal member 243 which extends from baffle 242 that is supported through movable linkage 241 which is supported by support 240 that is attached to a wall of tray 201. Identical structure supports the copy sheets opposite roll 224 as well. A curved baffle 213 that extends upright opposite the inside wall of tray 201 corrugates the stack and thereby increases the beam strength of the sheets in the stack. Baffle 242 is moved back toward support 240 for loading of new copy sheets into tray 201. It can be clearly seen in FIG. 3A that baffle 242 is in an unactuated position for copy sheet loading purposes and in FIG. 3B has been actuated and extended to a position just opposite the stack of sheets 17. Springs 222 are used to control the movement of baffles 242. In FIG. 5A, foot pedal 238 is in its home position and rolls 224 and 225 are removed from the stack, while in FIG. 5B, movement is shown in the pulley system and the rolls are moved into contact with the stack. A sheet is being fed in FIG. 5C due to continued downward movement of foot pedal 238.

In operation, a document is inserted into machine 8 in the direction of arrow A. The document advances to a point an stops for the insertion of a copy sheet. An operator then steps on foot pedal 238 which is connected to actuator 220 and feed rolls 224 and 225 via a pulley system 230. The actuator is moved from its home position placing the feed rolls onto the copy sheets as pressing of the foot pedal is continued. When the actuator is forced onto the copy sheets by the foot pedal, the shock applied to the top sheet in the stack provides inertial sheet separation and because the copy sheets are placed in the tray vertically, in this case approximately 90°, gravity retards the remaining sheets. Subsequent continued pressing of the foot pedal causes upward movement of the now locked feed rolls of the actuator with the friction between the feed rolls and the first sheet in the stack causing the copy sheet to move about 4–6" out of the tray past metering roll 212 and into the registration rolls of the machine as shown by arrow B. The microprocessor starts the document and copy sheet in synchronism with each other with the document traveling in the direction of arrow A and the copy sheet traveling in the direction of arrow B as shown in FIG. 1. This process is repeated as necessary for the number of copies required. Copy sheet movement sensor or metering roll 212 is included to indicate to the operator that 1.) a sheet has been fed from the storage tray and 2.) to indicate when the copy sheet has left the copier so that the operator can feed another document and subsequently press the foot pedal and feed another copy sheet.

It should now be understood that a cost effective roll-up device for the feeding of sheets from a feed tray to a copier has been disclosed that is simple, low cost, and foot operated or electrically driven. The paper feeder includes a foot pedal, a T-shaped actuator with feed means as a part thereof and a pulley system connecting the foot pedal to the actuator. The feed tray has a bottom surface that supports copy sheets at an angle of about 90° with respect to a horizontal plane in order to make use of gravity in inhibiting multifeeding.

While the invention has been described with reference to the structure shown, it is not confined to the specific details set forth, but is intended to cover such modifications or changes as may come within the scope of the following claims.

I claim:

1. A simple, low cost, roll-up paper feeder, comprising: a media chamber having media mounted in a vertical plane and allowing media to exit through an opening thereof into nips formed between idler and registration rolls of a copier apparatus; two position, T-shaped actuator means including a pair of one way clutch controlled rotating friction means mounted thereon for contacting media within the media chamber; rail means for slidably supporting said actuator means; and foot pedal means linkably connected to said actuator means such that when movement of said foot pedal means is initiated, said actuator means is moved in a first direction to a position contacting said media, with continued movement of said foot pedal means causing said actuator means to move in a second direction and thereby cause the top sheet of the media to be fed a predetermined amount through said opening within said media chamber into said nips formed between idler and registration rolls, and wherein release of said foot pedal means causes said actuator means to retract from the media surface and move in a third direction and thereafter to its initial position.

2. The roll-up paper feeder of claim 1, wherein said friction means comprises cylindrical rubber rolls.

3. The roll-up paper feeder of claim 1, wherein said media chamber is heated.

4. The roll-up paper feeder of claim 1, including a motion wheel that is actuated by movement of said media in order to indicate movement of said media.

5. The roll-up paper feeder of claim 4, including curl reducing means positioned in the same plane of and adjacent said friction means.

6. The roll-up paper feeder of claim 5, including concaved corrugation means extending throughout the width of said media chamber and having only end portions thereof contacting a wall of said media chamber in order to lend rigidity to said vertically standing media.

7. The roll-up paper feeder of claim 6, wherein said friction means comprises rolls, and wherein said rolls are mounted on an articulable shaft in order to prevent skewing of said media during the feeding process.

8. The roll-up paper feeder of claim 7, wherein said rolls are fixed to said shaft.

9. The roll-up paper feeder of claim 1, wherein said media chamber includes an attachment to an outside surface thereof that has a first compartment for stacking prefed original documents facing said copier apparatus and the restacking of post fed original documents facing away from said copier apparatus and a second compartment that is positioned to catch media exiting said copier apparatus.

10. The roll-up paper feeder of claim 9, wherein said second compartment that is positioned to catch media exiting said copier apparatus is configured such that a portion of said media automatically bends over a wall of said second compartment away from said copier apparatus.

11. A modular, self-contained roll-up paper feeder accessory to a copying machine, comprising: a paper tray mounted to support copy sheets in a substantially vertical plane and allows the copy sheets to exit through a top portion thereof; two position feed means including a pair of one way clutch controlled friction means mounted thereto for contacting said copy sheets, means for slidably supporting said feed means; and foot pedal means connected to said feed means such that when movement of said foot pedal means is initiated, said feed means is moved in a first direction to a position contacting said copy sheets, with continued movement of said foot pedal means causing said fed means to move in a second direction and thereby cause the top sheet of the copy sheets to be fed a predetermined amount through said top portion of said paper tray into nips formed between idler and registration rolls, and wherein release of said foot pedal means causes said actuator means to retract from the surface of the copy sheets and move in a third direction to its initial position.

12. A large copy sheet feeder configured as a self-contained, roll-up accessory to a copying machine, comprising: a tray positioned to support a stack of copy sheet media in a substantially vertical plane, and wherein said tray is heated; a feed means including compliant feed rolls, one-way clutch means connected to said feed rolls; and means for moving said feed rolls in an upward motion such that said feed rolls are locked by said one-way clutch means and deliver an individual copy sheet of the media from said stack to a ready-to-feed station of said copying machine followed by downward return of said feed rolls in an unlocked condition.

13. The roll-up paper feeder of claim 12, including a motion wheel that is actuated by movement of said media in order to indicate movement of said media.

14. The roll-up paper feeder of claim 13, including curl reducing means positioned in the same plane of and adjacent said friction means.

15. The roll-up paper feeder of claim 14, including concaved corrugation means extending throughout the width of said tray and having only end portions thereof contacting a wall of said tray in order to lend rigidity to said vertically standing media.

16. The roll-up paper feeder of claim 15, wherein said rolls are mounted on an articulable shaft in order to prevent skewing of said media during the feeding process.

17. The roll-up paper feeder of claim 16, wherein said rolls are fixed to said shaft.

18. The roll-up paper feeder of claim 12, wherein said tray includes an attachment to an outside surface thereof that has a first compartment for stacking prefed original documents facing said copier apparatus and the restacking of post fed original documents facing away from said copier apparatus and a second compartment that is positioned to catch media exiting said copier machine.

19. The roll-up paper feeder of claim 18, wherein said second compartment that is positioned to catch media exiting said copier machine is configured such that a portion of said media automatically bends over a wall of said second compartment away from said copier machine.

20. A large copy sheet feeder configured as a self-contained, roll-up accessory to a copying machine, including a paper tray positioned to support a stack of copy sheets in a substantially vertical plane; a document holding tray connected to an outer surface of said paper tray for holding original documents before they are fed to the copier and after they have been fed to the copier, an output tray connected to an outer surface of said document holding tray, said output tray having adjustable means thereon that changes the space within said output tray available to incoming copy sheets from the copying machine in order to accommodate a wide variety of copy sheet sizes.

21. The copy sheet feeder of claim 20, wherein said output tray includes a top portion slanted away from said outer surface of said document holding tray so that trailing edge portions of incoming copy sheets fold over said slanted top portion of said output tray.

22. The copy sheet feeder of claim 21, wherein printed portions of documents in said document tray face the copier before they are fed into the copier and face away from the copier after they have exited the copier.

23. The copy sheet feeder of claim 20, wherein a top surface of said feeder is a copy sheet bypass guide and copy sheet support surface that allows the feeding of individual copy sheets other than from the feeder.

* * * * *